United States Patent [19]

Dorn

[11] 3,942,179

[45] Mar. 2, 1976

[54] FILTERED-NOISE JAMMER

[75] Inventor: Clifford G. Dorn, Riverside, Calif.

[73] Assignee: The United States of America as represented by the Secretary of the Navy, Washington, D.C.

[22] Filed: Oct. 18, 1968

[21] Appl. No.: 768,935

[52] U.S. Cl. ..... 343/18 E
[51] Int. Cl.[2] ..... H04K 3/00
[58] Field of Search ..... 343/18 E

[56] References Cited

UNITED STATES PATENTS

| | | | |
|---|---|---|---|
| 2,416,307 | 2/1947 | Grieg | 343/18 E |
| 2,658,992 | 10/1953 | Byrne | 343/18 E |
| 2,885,543 | 5/1959 | Williams | 343/18 E |

OTHER PUBLICATIONS

Holahan, Tools and Techniques of Electronic Warfare, April, 1960, pp. 126–128.

*Primary Examiner*—Richard A. Farley
*Assistant Examiner*—G. E. Montone
*Attorney, Agent, or Firm*—Richard S. Sciascia; Joseph M. St.Amand; John W. Kozak

[57] ABSTRACT

A device for generating spot or barrage noise to jam communication equipment, missiles or radar employing a modulating noise that has the high frequencies removed. Said device comprises a filter means and an amplifier in circuit with the noise source, modulator and transmitter of a basic noise jamming device. The filtered output of said device has a non-uniform R.F. spectrum with a random noise density.

1 Claim, 2 Drawing Figures

CLIFFORD G. DORN
INVENTOR

BY

ATTORNEYS

FILTERED-NOISE JAMMER

The invention herein described may be manufactured and used by or for the Government of the United States of America for governmental purposes without the payment of any royalties thereon or therefor.

The present invention relates to a device for generating spot or barrage noise for jamming communication equipment, missiles or radar by the use of a modulating noise that has the high frequencies removed. More particularly, it relates to an improved filtered noise jamming device which radar will be unable to angle track either actively or passively and which a missile will be unable to home on either actively, semi-actively, or passively.

Prior art noise jamming devices consist essentially of a noise source, a modulator and a transmitter. Devices of this type produce a radio frequency (RF) spectrum of almost uniform density by employing a broad band of video noise, ranging in frequency from direct current to 5 MHz, for modulating the frequency of an RF transmitter. Such a uniform density RF spectrum is easily tracked by radar or homed on by a missile using passive homing and tracking techniques.

An object of the present invention is to provide an improved noise jamming device which produces a non-uniform RF spectrum with a random density pattern.

Another object of the present invention is to provide a filtered noise jamming device comprising a low-pass filter means for restricting the bandwidth of the modulating frequencies from the noise source in order to use this filtered noise to modulate the jamming device in order to produce spot or barrage-noise jamming.

A further object of the present invention is to provide a filtered noise jamming device which can be used against any type of equipment that a spot or barrage-noise jammer can be used against.

These objectives are accomplished in the present invention by employing a filtered noise jamming device comprising a low pass filter and an amplifier in circuit with the noise source, modulator and transmitter of a standard jamming device. The noise source generates a continuous spectrum of noise frequencies ranging from direct current to 5 MHz. Frequencies above a cut-off frequency, which may be between 500 Hz and 5 KHz, are filtered out by the low pass filter, allowing only those frequencies below the cut-off frequency to reach the output thus resulting in an output having a non-uniform density RF spectrum with a random density pattern.

Other objects and many of the attendant advantages of this invention will become readily appreciated as the same becomes better understood by reference to the following detailed description when considered in connection with the accompanying drawings wherein.

Figure 1:
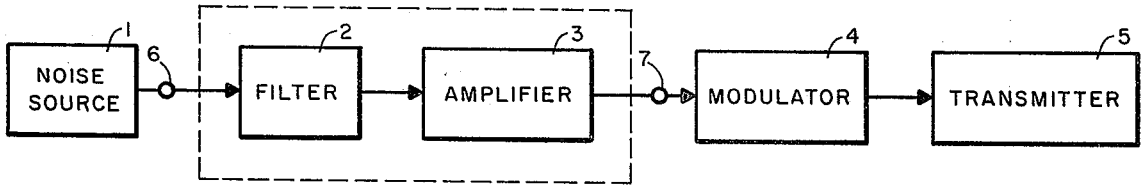
FIG. 1 is a block diagram showing the filtered jamming device of the present invention.
Figure 2:
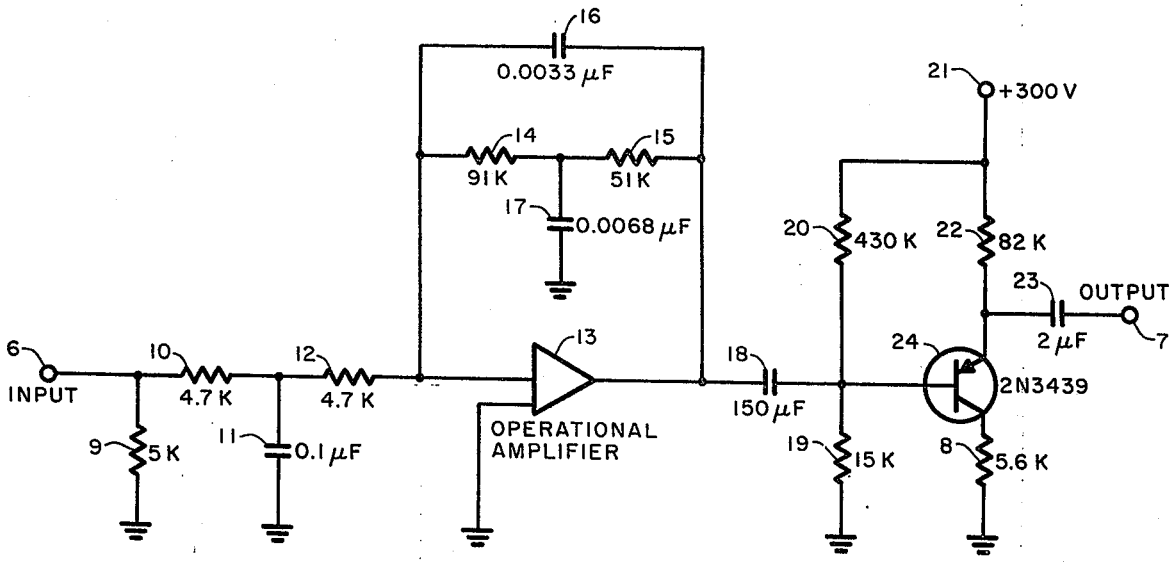
FIG. 2 is a circuit diagram showing one embodiment of the amplifier-filter means set out by the dashed line in FIG. 1.

Referring to FIG. 1, the filtered jamming device of the present invention comprises, in circuit, a noise source 1, filter means 2, an amplifier 3, modulating means 4, and a transmitter 5. The noise source 1, which can be of Type 8890-0024 manufactured by Elgenco Inc., Santa Monica, Calif., is coupled to a filter means 2 which in turn is in circuit with an amplifier 3. The amplifier 3 and filter means 2 can comprise a single, combined amplifier-filter circuit as shown in FIG. 2. Referring again to FIG. 1, the amplifier 3 is in circuit with modulating means 4 which can be of the type described by Sims and Stephenson, "Microwave Tubes and Semiconductor Devices," Interscience Publishers, 1963. Said modulating means 4 is in turn coupled to a transmitter 5 which can be of the "Backward-Wave Oscillator Type WJ-2017," manufactured by Watkins-Johnson, Palo Alto, California.

In operation, the noise source 1 generates a continuous spectrum of noise frequencies ranging from direct current to about 5 MHz. The filter means 2 serves as a low pass filter and attenuates all frequencies above a selected cut-off frequency within the range of from 500 Hz to 5 KHz. It is required that said filter means 2 provide a minimum attenuation of 20 db at frequencies above 8 KHz. The amplifier 3 amplifies the output of the filter means 2 in order to obtain the same rms voltage at input terminal 7 of the modulator 4 that was present when the output terminal 6 of the noise source 1 was directly coupled to the input terminal 7 of the modulator 4. If a different value of gain is desired, the amplifier 3 can be set accordingly. The noise jamming output of the present device has an RF spectrum having a non-uniform density with a random density pattern. Thus when the RF signal is received, the resultant video signal in the receiver, to be jammed, will appear as a series of varying amplitude spikes periodically saturating the subject receiver. During the time when the subject receiver is not saturated the varying amplitude signal interferes with any use of amplitude modulation as a means of tracking.

FIG. 2 is a circuit diagram of an embodiment of an amplifier-filter combination which has been found satisfactory in practice. Higher frequencies are blocked by the T-filter network comprising the resistor 10, capacitor 11 and resistor 12. The remaining direct current and lower frequencies pass to the operational amplifier 13. A feedback network comprising a capacitor 16 in parallel with a T-filter network consisting of a resistor 14, capacitor 17 and resistor 15 straddles the operational amplifier and serves to further reduce the high frequency components from the input signal. The capacitor 18 blocks the direct current component of the signal, thus permitting only low frequency components of the signal to reach the drive circuit which comprises a transistor 24 and resistors 8, 19, 20, 22. Said drive circuit serves as a power amplifier. Blocking capacitor 23 further eliminates any remaining direct current so that the output signal consists only of low frequency components.

The filter characteristics can be varied so that the RF source is modulated by various bands of frequency resulting in the jamming noise containing different frequency components.

Obviously many modifications and variations of the present invention are possible in the light of the above teachings. It is therefore to be understood that within the scope of the appended claims the invention may be practiced otherwise than as specifically described.

What is claimed is:

1. An improved noise jamming device for producing a non-uniform RF spectrum with a random density pattern comprising:

a. a noise source generating a continuous spectrum of noise frequencies from direct current to about 5 MHz, b. a low pass filter means in circuit with said noise source attenuating all frequencies above a selected cut-off frequency within the range of from 500 Hz to 5 KHz, c. an amplifier in circuit with said low pass filter means for amplifying the output of said low pass filter means, d. said low pass filter means and said amplifier in circuit therewith forming a single integrated circuit comprising:

1. a first T-filter network for filtering high frequencies which allow direct current and lower frequencies to pass,

2. an operational amplifier having a feedback network and a second T-filter both in parallel therewith, said operational amplifier connected to amplifier of said first T-filter for further reducing high frequency components from input signals thereto,

3. a drive circuit connected to the output of said operational amplifier, said drive circuit serving as a power amplifier, and

4. a blocking capacitor for eliminating any remaining direct current leaving an output of only low frequency components, e. a modulator in circuit with said amplifier and being responsive to the noise spectrum passed by said low pass filter means to produce a spot or barrage noise signal output having a non-uniform density RF spectrum with a random density pattern, and f. a transmitter in circuit with said modulator for transmitting the output signal from said modulator circuit.

* * * * *